United States Patent [19]

Pohto

[11] 4,105,529

[45] Aug. 8, 1978

[54] HELICAL INTERCELL CONNECTOR FOR ELECTROLYTIC CELLS

[75] Inventor: Gerald R. Pohto, Mentor, Ohio

[73] Assignee: Diamond Shamrock Corporation, Cleveland, Ohio

[21] Appl. No.: 801,579

[22] Filed: May 31, 1977

[51] Int. Cl.[2] ..... C25B 9/04

[52] U.S. Cl. ..... 204/267; 204/274; 204/279

[58] Field of Search ..... 204/279, 267, 268, 289, 204/270, 274

[56] References Cited

U.S. PATENT DOCUMENTS 3,565,783 2/1971 Emery et al. ..... 204/267

FOREIGN PATENT DOCUMENTS 25,340 of 1895 United Kingdom ..... 204/267

*Primary Examiner*—John H. Mack
*Assistant Examiner*—D. R. Valentine
*Attorney, Agent, or Firm*—Stephen A. Littlefield

[57] ABSTRACT

An electrical connector is described which has a helical form with its axis being parallel to the plane of each of the conductor bars to which it is directly connected. The helix has an open pitch which promotes air circulation for cool operation and the design reduces the amount of conductive metal utilized in the connection as well as being a cheaper, less complicated structure than previously known.

14 Claims, 4 Drawing Figures

HELICAL INTERCELL CONNECTOR FOR ELECTROLYTIC CELLS

BACKGROUND OF THE INVENTION

This invention relates generally to the art of electrical connectors and more particularly to an intercell electrical connector for conducting electric current between adjacent electrolytic cells and connection of the cells to a source of electrical power.

Electrolytic cells, such as cells used in the production of chlorine and caustic by the electrolysis of brine are commonly used in a commercial production facility as a multitude of individual cells connected in series thereby utilizing one power source to operate a number of such cells. Thus, an anode of one cell is connected to a cathode of an adjacent cell through an intercell bus bar connector until a row or bank of cells is built, all of which are electrically connected in series to a single power source.

Intercell bus bar connectors have previously been in the form of heavy copper bars of large cross-sectional area in order to minimize voltage losses across the connectors. In addition to utilizing large amounts of expensive copper, the operating temperature of the cells caused thermal expansion of the bars to a point where they could and did force the displacement of cell components due to the inflexibility of the bars.

Flexible connectors of several types have been developed. One type utilizes a flexible web of woven copper wire as a connector. While this solves the problem of inflexibility, the webs are complex in structure and must still utilize large amounts of copper for a given current load which contribute to increased expense for the connectors.

Another type of intercell connector is described in Emery et al, U.S. Pat. No. 3,565,783, in which an angled connector comprised a plurality of parallel, spaced sheets or cast leaves of conductive material provides the needed flexibility of connection. This structure, however, is no less complex in form than the web design and utilizes large amounts of copper, thus adding to both the weight and the expense of intercell connectors.

With any of the prior intercell electrical connectors, alignment of attachment points for the connector was somewhat critical. This increased the amount of labor necessary in both original installation and maintenance and repair of a cell bank.

Operating brine temperatures in electrolytic cells are commonly in the range of 190°-220° F. while the electrical connectors are at a higher temperature, generally about 230°-250° F. At these operating temperatures, there is a considerable amount of oxidation on copper surfaces of electrical intercell connectors exposed to the corrosive atmosphere surrounding an electrolytic cell. Such corrosion leads to heat build-up and increased resistance resulting in substantial power losses. Furthermore, corroded connectors present a maintenance problem due to increased necessity for replacement. A substantial reduction in the temperature of the connectors would significantly reduce both replacement costs and power loss.

Finally, the resistance heating of the current-carrying intercell connectors has long been a problem due to loss in conductivity as the temperature of the connector rose. While the effect may be only slight with respect to an individual connector, the multiplication factor over many interconnected cells makes this effect quite significant resulting in substantial power loss.

SUMMARY OF THE INVENTION

These and other problems of prior art intercell connectors are reduced or eliminated through the use of a helical intercell connector in accordance with the present invention.

In accordance with the invention, a helical member of conductive metal having a helical axis passing through center thereof is interposed between a pair of adjacent cells of an electrolytic cell bank and connected to each by connecting means such as a bifurcated battery cable type clamp. Each of the connecting means has a longitudinal axis which is disposed in a substantially parallel relationship with respect to the helical axis when connected therewith.

Further in accordance with the invention, the helical member of the type described has an open pitch so that air may circulate around the entirety of the helix.

Further in accordance with the invention, the helical member of the type described may be a solid copper helix, a multi strand copper cable or a tubular copper member.

Still further in accordance with the invention, a tubular helical connector of the type described is connected to a source of cooling fluid such as water or air so that the cooling fluid may pass through the tubular connector to effect the removal of heat therefrom.

It is therefore a principal object of this invention to provide an electrical connector for interconnecting adjacent electrolytic cells in a cell bank which has higher flexibility in all three modes of flexure than prior art connectors.

It is another object of this invention to reduce the amount of conductive material used in intercell connection in an electrolytic cell bank thereby reducing both the weight and the overall cost of the cell bank.

It is yet another object of the present invention to provide a connector which allows intercell connection without the criticality of cell alignment necessary with prior intercell connectors.

It is a still further object of this invention to provide an intercell connector which is cool in operation so as to reduce the power loss across the connection.

It is another object of the present invention to provide an intercell connector which may employ cooling means in order to maintain efficient, low temperature operation of the connector.

These and other objects of the invention are accomplished through a novel design of intercell connector to be described hereinafter.

BRIEF DESCRIPTION OF THE DRAWINGS

The invention will be further described in conjunction with the appended drawings illustrating a preferred embodiment of the invention and forming a part of this specification in which.

DETAILED DESCRIPTION OF THE DRAWINGS AND THE PREFERRED EMBODIMENT

Figure 1:
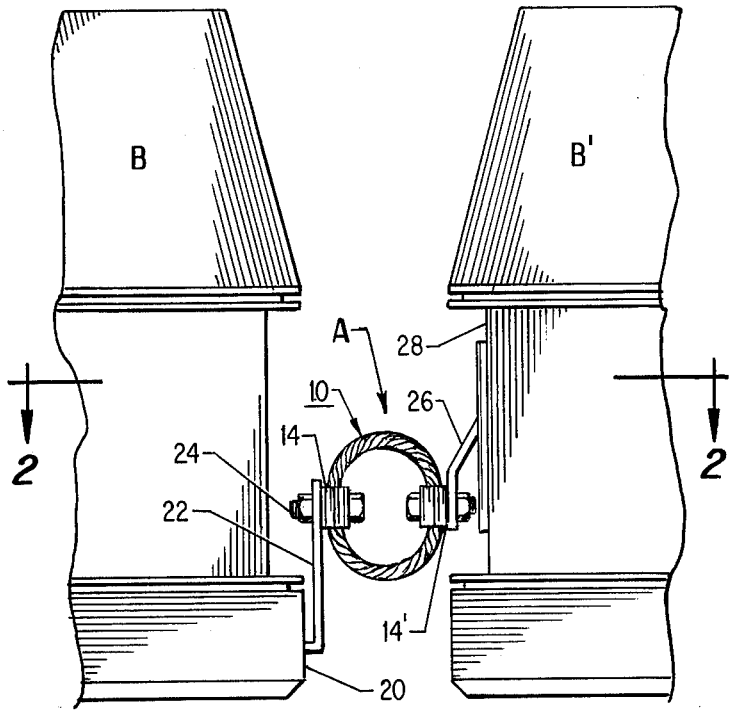
FIG. 1 is a schematic view of the preferred connector showing a typical intercell installation.

Referring now in greater detail to the drawings which are presented herewith for the purpose of illustrating the invention and not to be construed as a limitation upon same, FIG. 1 shows helical connector A establishing electrical connection between adjacent electrolytic cells B, B' in a cell bank. While it is to be understood that the connector of the invention may be applied to use in any electrolytic cell bank system, the invention will be illustratively described in conjunction with a diaphragm-type electrolytic cell bank.

Intercell connector A is comprised of helical member 10 having a plurality of loops 12. Helical member 10 is made of a conductive metal and is preferably made of beryllium copper. Helical member 10 may be in the form of a helically formed coper rod, copper cable or hollow copper tubing. Helical member 10 is preferably formed in a moderately open pitch, that is so that corresponding points on successive loops 12 are in a spaced relationship from each other rather than in an abutting relationship which would be considered a "closed pitch" as is known in the art of helical members. It is to be understood that an open pitch is merely preferred for reasons of air cooling and that a closed pitch helix may be utilized without departing from the scope of the invention.

Helical member 10 is clamped in open pitch form between a pair of bifurcated battery cable-type connector clamps 14,14', each half clamp having a plurality of spaced semicircular grooves along one side thereof which, when mated to its corresponding half, form a plurality of openings 16, each of which has a diameter which is equal to or preferably slightly less than the external diameter of helical member 10. Openings 16 may have knurls or serrations to improve electrical contact with helical member 10.

In assembling the intercell connector A, paired halves of bifurcated connector clamp 14 are fastened together so that successive loops 12 of helical member 10 pass through and are gripped by successive openings 16 in bifurcated connector clamp 14. The paired halves may be fastened by any means common in the art such as nuts and bolts or countersunk screws. Alternatively, a pair of longitudinal bars may be brazed directly to opposite sides of the helix so as to reduce voltage drops at the contacts and eliminate degradation of the joints at the interface between the helix and clamps.

It is preferred that two of such similarly assembled bifurcated clamps 14,14' be located on laterally opposite sides of helical member 10, parallel to the helical axis.

Intercell connector A is positioned between electrolytic cells B,B' and connected to cell B bottom section 20 through bus bar extensions 22 which are in turn connected to bifurcated connector clamp 14 by fastening means such as bolts 24.

Electrolytic cell B' has connector bars 26 extending from cathode wall portion 28. Connector bars 26 are connected to the other bifurcated clamp 14' by fastening means in a manner similar to the connection of bus bar extensions 22 to bifurcated clamp 14.

Figure 2:
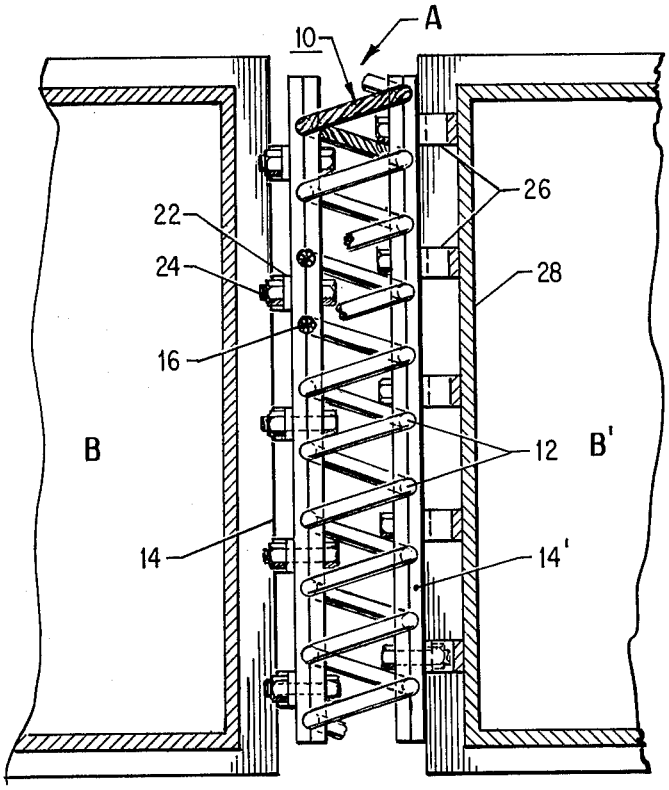
FIG. 2 is a top cross sectional view of the intercell connector of FIG. 1 taken along line 2—2 thereof.
Figure 3:
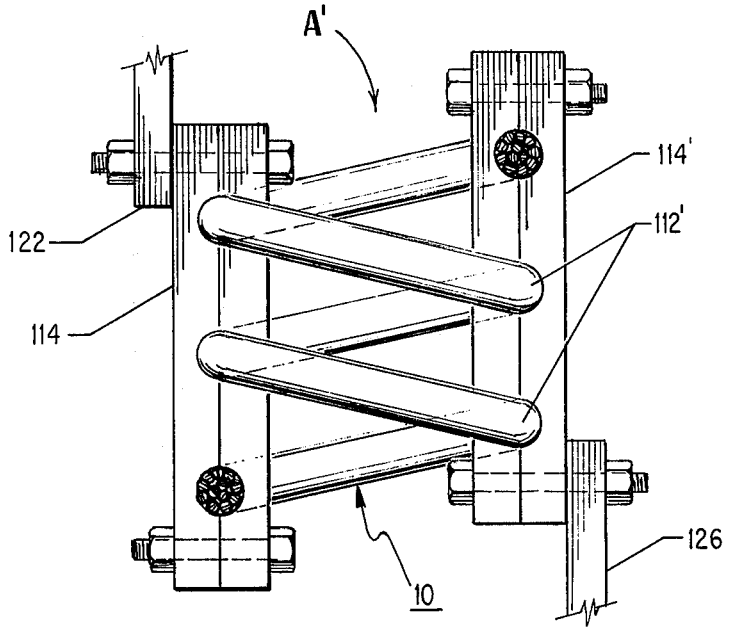
FIG. 3 is a side elevational view, in partial section of the connector.

Intercell connector A may be of a length so as to span substantially the entire width of an electrolytic cell such as is shown in FIG. 2 or, alternatively, the connector may be comprised of one or more shorter segments of a helical connector A' such as that shown in FIG. 3.

Intercell connector segment A' is comprised of helical member 110 having a plurality of loops 112 and a pair of bifurcated clamps 114,114' all of which are similar to the corresponding component in the embodiment shown in FIG. 2 but being shorter in axial length. Anode connector 122 and a cathode connector 126 are attached to bifurcated clamps 114,114' respectively, in the manner previously described.

It can be seen that the open pitch helical form of the intercell connector allows cooling in two directions, that is axially of the helix and transversally of the helical axis between the open pitched loops.

Figure 4:
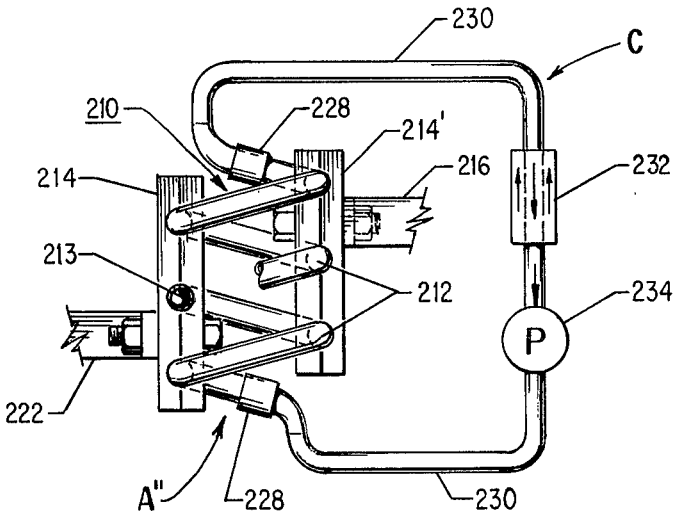
FIG. 4 shows an alternate embodiment of the connector.

Should additional connector cooling be desirable or required, the helical intercell connector A" may be formed from a hollow tube of conductive material such as that shown in FIG. 4.

As with the other embodiments, intercell connector A" is comprised of helical member 210 having a plurality of loops 212. Helical member 210 is formed as a thick walled tubular member having fluid passageway 213 passing centrally therethrough. Wall thickness of the tubular member should be such as to be capable of handling a clamping force without collapse of the tube walls. Bifurcated clamps 214,214' act as interconnection means between helical member 210 and anode and cathode conductor bars 222 and 226, respectively.

An external cooling fluid circuit C is illustrated schematically in FIG. 4 which is connected at the ends of tubular helical member 210. The circuit C comprises fluid connectors 228 and conduit 230 passing through a heat exchanger 232 and pump 234 before returning to helical member 210. Cooling circuit C is shown as a closed system but it will be understood that an open cooling circuit which does not recycle cooling fluid may also be used. Furthermore, a cooling circuit utilizing cell feed brine would accomplish a dual purpose of both cooling the intercell connector while preheating the feed brine to processing temperature. Other cooling fluids may be used in the cooling circuit C such as air, water, ethylene glycol, or combinations thereof.

The fluid-cooled intercell connector A" is illustrated as being of a short of segmented construction similar to that of FIG. 3. This embodiment is preferred rather than employing a long tubular helix so that a more even cooling of the helix length is achieved. The invention is not to be limited by such preference, however.

While the invention has been described in the more limited aspects of a preferred embodiment including specific parts and arrangement of parts, other embodiments have been suggested and still others will occur to those skilled in the art upon the reading and understanding of the foregoing specification. It is intended that all such embodiments be included within the scope of the invention as defined only by the appended claims.

What is claimed is:

1. In an electrically connected series of electrolytic cells, comprising a plurality of adjacent, series-connected cells each having an anode portion and a cathode portion and anode and cathode connectors extending respectively therefrom, said anode connector of one cell positioned so as to extend generally in the direction of said cathode connector of an adjacent cell, an intercell connector means for establishing series electrical connection between said anode and adjacent cathode connectors comprising:

a helical member having a plurality of loops and a helical axis disposed between said anode and cathode connectors;

a pair of connecting means engaging said helical member having a longitudinal axis parallel to said helical axis, and fastening means for establishing positive connection of each of said anode and cathode connectors to an adjacent one of said connecting means.

2. The series of electrolytic cells as described in claim 1 wherein said pair of connecting means comprises a pair of bifurcated longitudinal bars having openings therethrough for engaging said loops of said helical member.

3. The series of electrolytic cells as described in claim 1 in which said helical member is a solid helical rod.

4. The series of electrolytic cells as described in claim 1 wherein said helical member is a helically formed multi-strand cable.

5. The series of electrolytic cells as described in claim 1 wherein said helical member is a helically formed, thick-walled tubular member having end portions.

6. The series of electrolytic cells as described in claim 5 further including fluid cooling means connected to said end portions of said helical member.

7. The series of electrolytic cells as described in claim 1 including a plurality of said anode and cathode connectors each disposed linerally relative to each other along said electrolytic cells and in which said helical axis is disposed parallel thereto.

8. The series of electrolytic cells as described in claim 7 wherein said helical member is segmented into a plurality of helical members disposed along a common helical axis.

9. The series of electrolytic cells as described in claim 1 wherein said helical member has an open pitch.

10. The series of electrolytic cells as described in claim 6 in which said cooling means includes air.

11. The series of electrolytic cells as described in claim 6 in which said cooling means includes water.

12. The series of electrolytic cells as described in claim 6 in which said cooling means includes brine.

13. The series of electrolytic cells as described in claim 6 in which said cooling means includes ethylene glycol.

14. The series of electrolytic cells as described in claim 6 in which said cooling means includes a mixture of water and ethylene glycol.

* * * * *